United States Patent [19]

Miyaoka

[11] 4,119,883

[45] Oct. 10, 1978

[54] CATHODE RAY TUBE

[75] Inventor: Senri Miyaoka, Fujisawa, Japan

[73] Assignee: Sony Corporation, Tokyo, Japan

[21] Appl. No.: 601,052

[22] Filed: Aug. 1, 1975

Related U.S. Application Data

[63] Continuation-in-part of Ser. No. 545,513, Jan. 30, 1975, abandoned, which is a continuation of Ser. No. 49,329, Jun. 24, 1970, abandoned.

[30] Foreign Application Priority Data

Jun. 30, 1969 [JP] Japan ..... 44-51889

[51] Int. Cl.[2] ..... H01J 29/51

[52] U.S. Cl. ..... 313/414; 315/13 C

[58] Field of Search ..... 313/414

[56] References Cited

U.S. PATENT DOCUMENTS

| | | | |
|---|---|---|---|
| 3,243,625 | 3/1965 | Levine et al. | 313/468 |
| 3,432,718 | 3/1969 | Preisig | 315/411 |
| 3,448,316 | 6/1969 | Yoshida et al. | 313/412 |
| 3,603,839 | 9/1971 | Takayanagi | 315/13 |
| 3,755,703 | 8/1973 | Ueno et al. | 313/409 |
| 3,883,771 | 5/1975 | Ohgoshi et al. | 313/414 |

*Primary Examiner*—Robert Segal

*Attorney, Agent, or Firm*—Lewis H. Eslinger; Alvin Sinderbrand

[57] ABSTRACT

In a cathode ray tube of the single-gun, plural-beam type in which the plurality of beams are made to intersect each other substantially at the optical center of a main focusing lens, any disparity in the focusing effects imparted to the respective beams by the main focusing lens and any auxiliary lens is corrected by applying suitably different biasing voltages to the cathodes emitting the respective beams so that the beams are subjected to different accelerations and travel through the lens fields at different speeds. Thus, the focusing effects of the lens fields on the respective beams are varied to cause the beams to be precisely focused on the screen. The cathode and control grid electrodes are physically arranged to permit control of the individual beam currents for proper color balance.

11 Claims, 6 Drawing Figures

CATHODE RAY TUBE

This application is a continuation-in-part of application Ser. No. 545,513, filed Jan. 30, 1975, the latter being a continuation of application Ser. No. 49,329, filed June 24, 1970, both applications being abandoned.

This invention relates generally to cathode ray or color picture tubes of the single-gun, plural-beam type, and particularly to tubes of that type in which the plural beams are passed substantially through the optical center of a common electron lens by which the beams are intended to be focused on the color phosphor screen.

In single-gun, plural-beam color picture tubes of the type to which this invention relates, for example, as specifically disclosed in U.S. Pat. No. 3,448,316, issued June 3, 1969, and having a common assignee herewith, a plurality of electron beams are emitted or originated by a beam generating cathode assembly and converged to cross or intersect each other at a location between the cathode assembly and the color screen upon which the beams impinge, and a single main focusing lens for focusing all of the beams on the screen is positioned to dispose its optical center substantially at the location where the beams intersect, whereby the coma and spherical aberrations that may be imparted to the beams by the main focusing lens are substantially diminished.

When the beams are thus converged to intersect each other substantially at the optical center of the main focusing lens, at least certain of the beams emerge from the lens along divergent paths, and pairs of convergence deflecting plates may be arranged along such divergent paths and have voltages applied thereacross to deflect the divergent beams in directions for causing all of the beams to converge at a common point on the apertured beam selecting grill or mask associated with the color screen, or the divergent beams may be allowed to land on the beam selecting grill or mask at spaced locations with suitable time delays being applied to the color signals by which the respective beams are modulated so as to obtain correspondence of the pictures produced on the screen. In either case, the beams are acted upon by the magnetic fields resulting from the application of horizontal and vertical sweep signals to the corresponding coils of a deflection yoke, whereby the beams are made to scan the screen in the desired raster.

In single-gun, plural-beam color picture tubes as described above, the beams pass through the main focusing lens at different respective angles to the axis of the lens, causing the beams to receive different respective focusing effects and thereby causing the beams to be focused at different respective distances from the main focusing lens.

Furthermore, single-gun, plural-beam color picture tubes as described above generally include an auxiliary lens positioned between the beam generating means and the main focusing lens. Such auxiliary lens is employed to prefocus the beams and sometimes also to converge the beams so that they cross or intersect each other substantially at the optical center of the main focusing lens. In such color picture tubes, the beams pass through the auxiliary lens at different respective distances from the optical axis of the lens, causing the beams to receive different prefocusing effects and thereby also causing a difference between the focusing distances for the respective beams. This disparity in beam focusing distances cases certain of the beams to impinge upon the screen in a slightly unfocused condition relative to another of the beams, resulting in unequal beam spot sizes and thus producing pictures having less than perfect resolution.

Accordingly, it is generally an object of this invention to provide a cathode ray or color picture tube of the described type having high resolution of the picture on the screen.

More specifically, it is an object of this invention to provide a cathode ray or color picture tube of the described type in which all of the beams are focused at substantially the same distance from the main focusing lens, so that such beams will impinge on the screen at sharply defined spots of substantially uniform size.

In accordance with an aspect of this invention, a cathode ray or color picture tube of the single-gun, plural-beam type described above is provided with means by which the speeds at which the beams travel through a lens field are made different to provide suitable correction for any disparity in the focusing effect imparted to the beams.

It is a feature of this invention to vary the speeds of travel of the beams through the lens field, for example, the field of the auxiliary lens, by means of a circuit arrangement which applies different biasing potentials to the cathodes emitting the respective beams, whereby the potential differences between such cathodes and an accelerating grid are also different to impart different accelerating effects to the beams. The electrode structure of the cathodes and control grid or grids permits the beam currents to be balanced for proper color control of the television image.

The above, and other objects, features and advantages of the invention, will be apparent in the following detailed description of illustrative embodiments thereof which is to be read in connection with the accompanying drawings, in which.

In order that the single-gun, plural-beam color picture tubes according to the present invention may be better understood, the principles and features of prior single-gun, plural-beam color picture tubes will first be described in detail with reference to FIG. 1.

Figure 1:
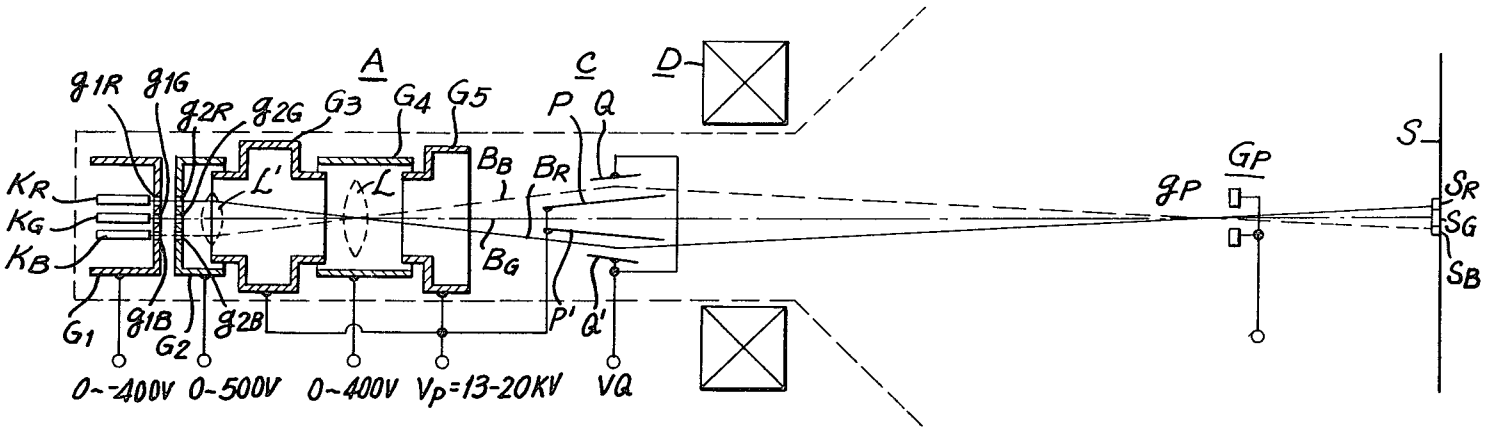
FIG. 1 is a schematic, horizontal sectional view of an existing single-gun, plural-beam color picture tube.

It will be seen that the prior art single-gun, plural-beam color picture tube shown on FIG. 1 comprises a glass envelope E having a neck and a cone extending from the neck to a color screen S provided with the usual arrays of color phosphors $S_R$, $S_G$ and $S_B$. Disposed within the neck is a single electron gun A including three cathodes $K_R$, $K_G$ and $K_B$, having their respective beam-generating surfaces disposed as shown so that the respective beams $B_R$, $B_G$ and $B_B$ emitted therefrom are directed in a substantially horizontal plane containing the axis of the gun, with the central beam $B_G$ being coincident with such axis and the side beams $B_R$ and $B_B$ being parallel thereto. A first or control grid $G_1$ is spaced from the beam-generating surfaces of cathodes $K_R$, $K_G$ and $K_B$ and has apertures $g_{1R}$, $g_{1G}$ and $g_{1B}$ formed therein in alignment wth the respective cathode beam-generating surfaces. A common accelerating grid $G_2$ is spaced from the first grid and has apertures $g_{2R}$, $g_{2G}$ and $g_{2B}$ formed therein in alignment with the respective apertures of the first grid. Cathodes $K_R$, $K_G$ and $K_B$ and grids $G_1$ and $G_2$ cooperate to form three beam-generating means. Successively arranged in the axial direction away from the common grid $G_2$ are open-ended, tubular grids or electrodes $G_3$, $G_4$ and $G_5$, respectively, with cathodes $K_R$, $K_G$ and $K_B$, grids $G_1$ and $G_2$, and electrodes $G_3$, $G_4$ and $G_5$ being maintained in the depicted assembled positions thereof, by suitable, non-illustrated support means of an insulating material.

For operation of the color picture tube of FIG. 1, appropriate voltages are applied to the grids $G_1$ and $G_2$ and to the electrodes $G_3$, $G_4$ and $G_5$. For example, a voltage of 0 to −400 V is applied to grid $G_1$, a voltage of 0 to 500 V is applied to grid $G_2$, a voltage of 13 to 20 KV is applied to electrodes $G_3$ and $G_5$ and a voltage of 0 to 400 V is applied to electrode $G_4$, with all of such voltages being relative to the bias voltage of cathodes $K_R$, $K_G$ and $K_B$. Such voltage distribution serves to establish an electron lens field around the axis of electrode $G_3$ to form an auxiliary lens L′, which is indicated by its optical equivalent, and an electron lens field around the axis of electrode $G_4$ to form a main focusing lens L, which is indicated by its optical equivalent. Auxiliary lens L′ prefocuses beams $B_G$, $B_B$ and $B_R$ and causes side beams $B_R$ and $B_B$ to converge so that they cross or intersect with beam $B_G$ substantially at the optical center of main focusing lens L.

Also included in the color picture tube of FIG. 1 are electron beam convergence deflecting means C which comprise shielding plates P and P′ disposed in the depicted spaced, relationship at opposite sides of the tube axis, and axially extending, deflector plates Q and Q′ which are disposed, as shown, in outwardly spaced, opposed relationship to shielding plates P and P′, respectively.

The shielding plates P and P′ are equally charged and disposed so that the central electron beam $B_G$ will pass substantially undeflected between the shielding plates P and P′, while the deflector plates Q and Q′ have negative charges with respect to the plates P and P′ so that electron beams $B_B$ and $B_R$ will be convergently deflected, as shown, by the respective passages thereof between the plates P and Q and the plates P′ and Q′.

In operation, electron beams $B_R$, $B_G$ and $B_B$ which emanate from the beam generating surfaces of cathodes $K_R$, $K_G$ and $K_B$ will pass through the respective grid apertures $g_{1R}$, $g_{1G}$ and $g_{1B}$, to be intensity modulated with what may be termed the "red", "green" and "blue" intensity modulation signals applied between the said cathodes and the first or control grid $G_1$. Due to the potential difference between cathodes $K_R$, $K_G$ and $K_B$ and grid $G_2$, the beams are accelerated. When the cathodes have the same bias potential, as in the prior art, the beams are uniformly accelerated. The electron beams will then be prefocused and converged by the auxiliary lens L′ to cross each other substantially at the optical center of the main lens L and to emerge from the latter with beams $B_R$ and $B_B$ diverging from beam $B_G$. Thereafter, the central electron beam $B_G$ will pass substantially undeflected between shielding plates P and P′ since the latter are at the same potential. Passage of the electron beam $B_B$ between the plates P′ and Q′ and of the electron beam $B_R$ between the plates P and Q will however, result in the convergent deflections thereof as a result of the voltages applied therebetween, and the system of FIG. 1 is so arranged that the electron beams $B_B$, $B_G$ and $B_R$ will desirably converge at an aperture $g_p$ of a beam selecting aperture grill or mask $G_p$ and diverge therefrom to land on the respective phosphors in a corresponding area of screen S.

Electron beam scanning of the face of the color phosphor screen is effected by deflection yoke D, which receives horizontal and vertical sweep signals whereby the beams are made to scan the screens in the desired raster.

Figure 2:
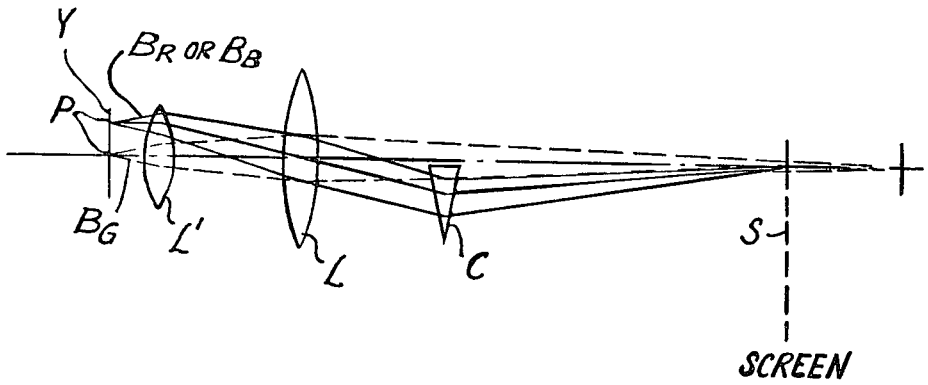
FIGS. 2 and 3 are diagrammatic views illustrating the optical equivalent or analogy of the color picture tube shown on FIG. 1, and showing two different conditions that may result from the different focusing effects imparted to the beams.

Referring to FIG. 2, which is a diagrammatic view illustrating the optical equivalent or analogy of the prior art, single-gun, plural-beam color picture tube shown in FIG. 1, the focusing characteristics of that tube will now be explained. Note that for simplicity, only one of the side beams $B_R$ and $B_B$ is shown, as the other would appear symmetrically identical about the axis of the tube.

Central beam $B_G$ and side beam $B_R$ or $B_B$ are shown as originating parallel to each other from their respective optical image points P located on a straight line Y. Side beam $B_R$ or $B_B$ passes through auxiliary lens L′ at a distance from its optical axis so as to be prefocused and deflected by the auxiliary lens, while central beam $B_G$ passes through lens L′ substantially along the optical axis and is merely prefocused thereby. A different prefocusing effect is imparted to side beam $B_R$ or $B_B$ than to central beam $B_G$. Specifically, side beam $B_R$ or $B_B$ is prefocused to a greater degree than central beam $B_G$. Furthermore, side beam $B_R$ or $B_B$ passes through main focusing lens L at an angle to the optical axis of the latter while central beam $B_G$ passes through it substantially along the optical axis. This causes a different focusing effect to be imparted to side beam $B_R$ or $B_B$ than to central beam $B_G$. Once again, side beam $B_R$ or $B_B$ is focused to a greater degree than central beam $B_G$. This results in side beam $B_R$ or $B_B$ being focused closer to main lens L than central beam $B_G$.

Figure 3:
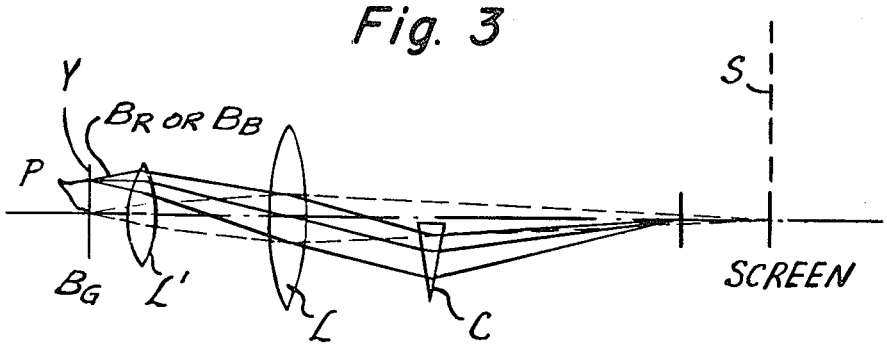

If the screen S is located at the focus point of side beam $B_R$ or $B_B$, central beam $B_G$ would impinge upon screen S in a slightly unfocused condition and would thus produce a larger spot than that produced by side beam $B_R$ or $B_B$. Similarly, if screen S was moved to a location corresponding to the focus point of central beam $B_G$, as shown on FIG. 3, side beam $B_R$ or $B_B$ would impinge on the screen in a slightly unfocused condition and would thus produce a larger spot than that produced by central beam $B_G$. Thus, the disparity in beam focusing distances would produce a picture having less than perfect resolution.

In accordance with the present invention, the acceleration imparted to central beam $B_G$ by the potential difference between its cathode $K_G$ and grid $G_2$ is reduced relative to the accelerations imparted to side beams $B_R$ and $B_B$ by the potential difference between cathodes $K_B$ and $K_R$ and grid $G_2$, whereby the central beam $B_G$ will travel at a relatively slower speed through the electric field constituting auxiliary lens L′ for increasing the time during which central beam $B_G$ is exposed to the focusing effect of the auxiliary lens. Thus, the prefocusing effect of auxiliary lens L′ on central beam $B_G$ is sufficiently increased to cause focusing of that beam at the same plane at which beams $B_R$ and $B_B$ are focused. Preferably, the acceleration imparted to central beam $B_G$ is relatively reduced, as aforesaid, by applying to its cathode $K_G$ a bias voltage that is greater than the bias voltages applied to the cathodes $K_R$ and $K_B$ emitting the side beams $B_R$ and $B_B$.

Figure 4:
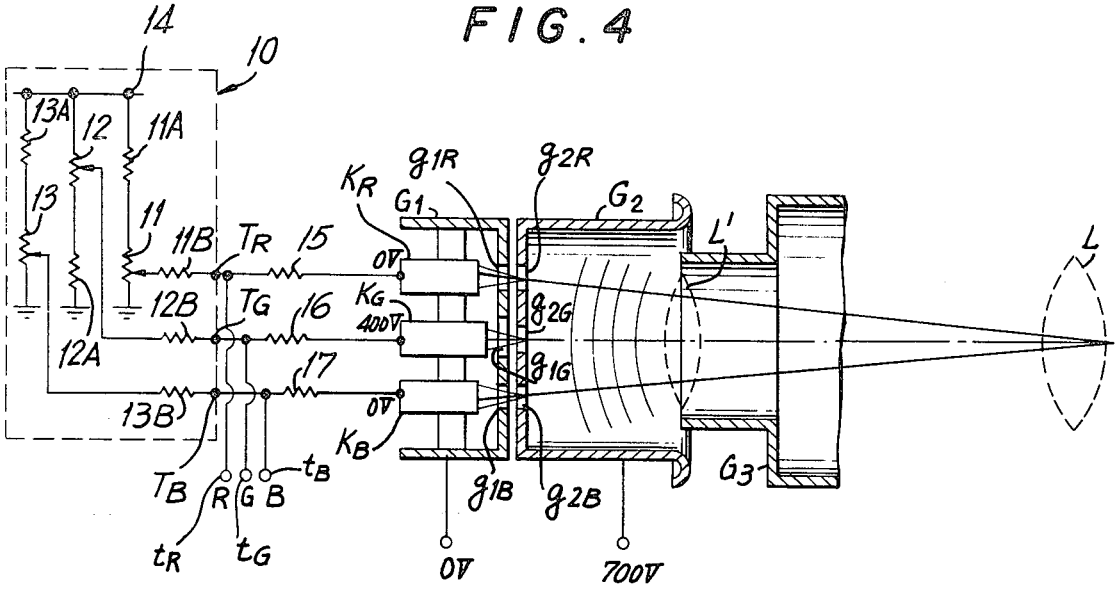
FIG. 4 is a fragmentary schematic sectional view similar to a portion of FIG. 1, and diagrammatically illustrating a circuit arrangement provided according to this invention for correcting any disparity in the focusing effects imparted to the beams.

Referring now to FIG. 4, it will be seen that, in the embodiment of the invention there illustrated, a cathode ray tube of the type described above with reference to FIG. 1 has its cathodes $K_R$, $K_G$ and $K_B$ connected with a biasing circuit 10 comprising a voltage dividing network of variable resistors, or potentiometers, 11, 12 and 13 in series with fixed resistors 11A, 12A and 13A, respectively. The series connected resistors 11 and 11A, 12 and 12A, 13 and 13A are connected in parallel between a D.C. power supply terminal 14 and ground, with the variable resistor 12 being disposed in advance of its related fixed resistor 12A, while the variable resistors 11 and 13 are disposed after the respective fixed resistors 11A and 13A. The movable taps of resistors 11, 12 and 13 are connected through fixed resistors 11B, 12B and 13B, respectively, to output terminals $T_R$, $T_G$ and $T_B$ which are, in turn, connected through protective resistors 15, 16 and 17 to cathodes $K_R$, $K_G$ and $K_B$. Further, terminals $t_R$, $t_G$ and $t_B$ for receiving the color video signals R, G and B for modulating beams $B_R$, $B_G$ and $B_B$ are respectively connected between terminal $T_R$ and resistor 15, terminal $T_G$ and resistor 16, and terminal $T_B$ and resistor 17.

It will be apparent that, with the voltage divider circuit arrangement, as shown, the bias voltage or potential applied to cathode $K_G$ for the central beam $B_G$ can be made larger than the bias voltages or potentials applied to cathodes $K_R$ and $K_B$ for side beams $B_R$ and $B_B$. For example, in accordance with this invention, the various fixed resistors are selected and the variable resistors 11, 12 and 13 are adjusted so that the cathode $K_G$ has applied thereto a bias voltage of 400 V and the cathodes $K_R$ and $K_B$ each have applied thereto a 0 V bias voltage, while the control grid $G_1$ has applied thereto a bias voltage of 0 V and the accelerating grid $G_2$ has applied thereto a bias voltage of 700 V. In the case of the foregoing example, the potential difference between cathode $K_G$ and grid $G_2$ is 300 V, while the potential difference between cathode $K_R$ and grid $G_2$ and between $K_B$ and grid $G_2$ is 700 V. Thus, side beams $B_R$ and $B_B$ are subjected to substantially greater acceleration than central beam $B_G$, whereby side beams $B_R$ and $B_B$ travel through the field constituting auxiliary lens L' at a substantially greater speed than that at which central beam $B_G$ travels through such field.

Figure 6:
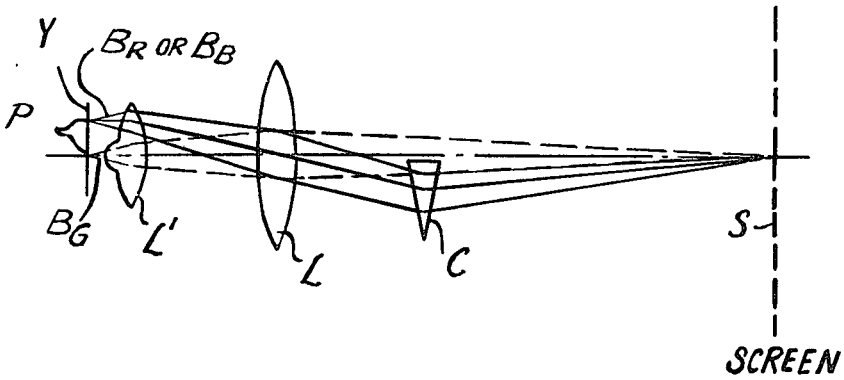
FIG. 6 is a diagrammatic view of the optical analog of the embodiment in FIG. 4.

FIG. 6 shows the optical analog in which the effect of such speed differential causes beam $B_G$ to be exposed to the field of lens L' for an increased time, and thus to be subjected to an increased focusing effect by lens L' to compensate for the increased focusing effects imparted to side beams $B_R$ and $B_B$ by lenses L' and L, as described above. This increased focusing effect is represented by an additional curved surface L'' on the analog lens L'.

Due to the difference in bias between central cathode $K_G$ and side cathodes $K_R$ and $K_B$ relative to control grid $G_1$, means are provided to equalize the beam currents of the three beams $B_R$, $B_G$ and $B_B$ to permit the brightness of the three phosphors $S_R$, $S_G$ and $S_B$ to be equalized. The beam current is mainly determined by the voltage difference between the control grid $G_1$ and the respective cathode $K_R$, $K_G$ or $K_B$. Since this voltage difference is determined by the requirement for equalizing focusing of the three beams, the values of the beam currents or beam densities are determined by the respective sizes of the apertures $g_{1R}$, $g_{1G}$ and $g_{1B}$ or, by the distance of the respective cathode $K_R$, $K_G$ or $K_B$ from the apertured surface of control grid $G_1$.

FIG. 4 illustrates a structure in which both of these dimensional factors are used: cathode $K_G$ is closer to control grid $G_1$ than cathodes $K_R$ and $K_B$ are, and aperture $g_{1G}$ is larger than apertures $g_{1R}$ or $g_{1G}$. Either the closer spacing of cathode $K_G$ and control grid $G_1$ or the larger size of aperture $g_{1G}$ would increase the beam current of beam $B_G$. Since the spacing and aperture size factors are additive, they may be used alternatively or in combination.

In the embodiment of FIG. 4, the invention is applied to a single-gun, plural-beam cathode ray tube in which the auxiliary lens L' is employed both to prefocus the beams and to cause deflection of the side beams $B_R$ and $B_B$ so that such beams will converge to intersect with the central beam $B_G$ substantially at the optical center of the main focusing lens L. However, the invention can also be applied to a cathode ray tube in which the beams are otherwise made to intersect substantially at the optical center of the main focusing lens, that is, in which the auxiliary lens only serves to prefocus the beams.

Figure 5:
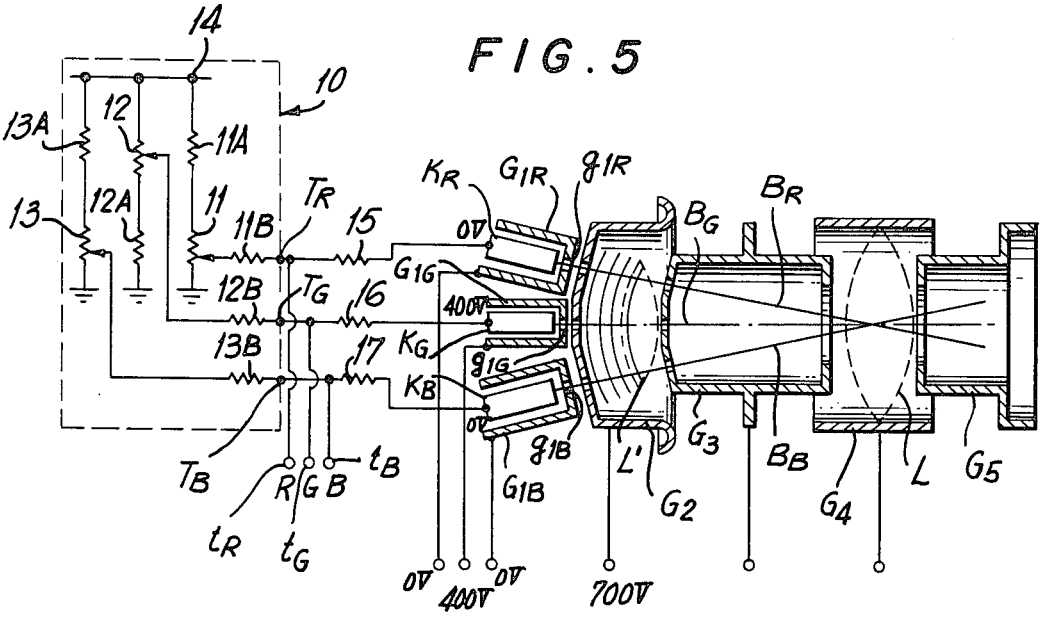
FIG. 5 is a view similar to that of FIG. 4, but showing another embodiment of this invention.

For example, as shown on FIG. 5, the biasing circuit 10 may also be employed in connection with another single-gun, plural-beam color picture tube which operates in substantially the same manner as that of FIGS. 1 and 4, with the exception that the cathodes $K_R$, $K_G$ and $K_B$ are arranged as shown on an arcuate surface whose center substantially corresponds with the optical center of main lens L so that the respective beams $B_R$, $B_G$ and $B_B$ emitted therefrom are directed in a substantially horizontal plane containing the axis of the gun, with the central beam $B_G$ being coincident with such axis and the side beams $B_R$ and $B_B$ converging toward the axis so that they intersect substantially at the optical center of main lens L. While this eliminates the need for the converging function of auxiliary lens L', an auxiliary lens may still be employed to prefocus beams $B_G$, $B_B$ and $B_R$. Further, in the gun of FIG. 5, the first or control grid is constituted by an assembly of three individual grids $G_{1R}$, $G_{1G}$ and $G_{1B}$ suitably arranged about cathodes $K_R$, $K_G$ and $K_B$ to provide uniform spacing between the cathodes and apertures $g_{1R}$, $g_{1G}$ and $g_{1B}$, respectively.

For operation of the color picture tube of FIG. 5, appropriate voltages are applied to the grids $G_2$ and the electrodes $G_3$, $G_4$ and $G_5$, so as to establish an electron lens field in grid $G_2$ to form an auxiliary lens L', which is indicated by its optical equivalent, and an electron lens field around the axis of electrode $G_4$ to form a main focusing lens L, which is indicated by its optical equivalent. The end surfaces of grid $G_2$ and electrode $G_3$ may be suitably shaped so that they are substantially perpendicular to the beams $B_R$, $B_G$ and $B_B$, whereby the electron lens field forming auxiliary lens L' will be shaped to prefocus the beams and to avoid further convergence of the beams.

In the cathode ray tube shown on FIG. 5, the side beams $B_R$ and $B_B$ again tend to be subjected to greater focusing effects than the central beam $B_G$ and, in accordance with this invention, this disparity in the focusing effects is compensated for by employing the previously described circuit 10 for applying a bias voltage to central cathode $K_G$ that is greater than the bias voltage applied to each of the side cathodes $K_R$ and $K_B$. Further, in the embodiment of FIG. 5, the individual first grids $G_{1R}$, $G_{1G}$ and $G_{1G}$ preferably have applied thereto bias voltages that are the same as the bias voltages applied to the respective cathodes. Thus, for example, in the case where the bias voltage applied to cathode $K_G$ is 400 V and each of cathodes $K_R$ and $K_B$ receive a 0 V bias voltage, the bias voltages applied to grids $G_{1R}$, $G_{1G}$ and $G_{1B}$ are also 0 V, 400 V and 0 V, respectively. When the bias voltage applied to accelerating grid $G_2$ is 700 V, as shown, the arrangement of FIG. 5 will operate in the same manner as described with respect to that of FIG. 4 to increase the focusing effect of lens L′ on central beam $B_G$ and thereby to achieve focusing of all three beams precisely at the color screen of the tube while still permitting the three beams to have equal currents controlled by the equal cathode control grid bias.

It will be apparent that, in each of the embodiments shown on FIGS. 4 and 5, the variable resistors 11, 12 and 13 make it possible to precisely adjust the position of focus for each beam, whereby to attain a picture with optimum resolution as to each primary color, and in both embodiments the beam currents are equalized.

Although illustrative embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention.

What is claimed is:

1. In combination, a cathode ray tube having a phosphor screen to reproduce color images, beam producing means for directing a plurality of electron beams to impinge on said screen and which are made to intersect each other at a point in said tube between said beam producing means and said screen and lens means common to all of said beams and including main focusing lens means positioned to dispose the optical center thereof substantially at said point where said beams intersect, at least a first and a second of said beams passing through said main focusing lens at substantially equal angles with respect to the optical axis of said lens, said angles being greater than the angle of a third of said beams with respect to the optical axis of said lens, said beam producing means comprising a plurality of individual cathodes to emit the respective electron beams, control grid means located adjacent said cathodes between said cathodes and said main focusing lens means, accelerating grid means located between said control grid means and said main focusing lens means, and brightness equalizing means to obtain color balance of the color images; and bias circuit means operative to establish different voltage potential differentials between said accelerating grid means and each of said cathodes corresponding to said first and second beams and said third beam, the voltage potential differential applied to said cathode corresponding to said third beam being substantially smaller than the voltage potential differentials applied to said cathodes corresponding to said first and second beams so that the beam velocity of said third beam is made substantially smaller than the respective beam velocities of said first and second beams in order to equalize focusing effects of said lens means on all of said beams.

2. The combination according to claim 1, in which said lens means includes an auxiliary lens, positioned between said beam producing means and said main focusing lens.

3. The combination according to claim 2, in which said first and second beams pass through said auxiliary lens at greater distances from the optical axis of said auxiliary lens than said third beam so that prefocusing effects imparted to said first and second beams by said auxiliary lens are different than those imparted to said third beam.

4. The combination according to claim 2 in which said cathode corresponding to said third beam is arranged along the optical axis of said lens means and said cathodes corresponding to said first and second beams are equally spaced from said one cathode at opposite sides of the latter.

5. The combination according to claim 4, in which said three cathodes are aligned in parallel so that said beams issue therefrom substantially parallel to the optical axis of said lens means and said auxiliary lens converges said beams so that they intersect each other substantially at the optical center of said main focusing lens.

6. The combination of claim 1, in which said brightness equalizing means comprises means spacing said cathodes corresponding to said first and second beams farther from said control grid means than the distance of said cathode corresponding to said third beam from said control grid means.

7. The combination of claim 1, in which said control grid means comprises a separate aperture for each of said beams and said brightness equalizing means comprises a larger said aperture for said third beam than said apertures for said first and second beams.

8. The combination according to claim 4, in which said three cathodes are arranged so that said beams issue therefrom in a convergent manner to intersect each other substantially at the optical center of said main focusing lens.

9. The combination according to claim 8, in which said control grid means includes an individual first grid corresponding to each of said cathodes and being at the same bias potential as the respective cathode.

10. The combination according to claim 1, in which said cathode corresponding to said third beam is arranged along the optical axis of said lens means and said cathodes corresponding to said first and second beams are equally spaced from said one cathode at opposite sides of the latter.

11. The combination of claim 1, in which said control grid means comprises a separate aperture for each of said beams, and said brightness equalizing means comprises a larger said aperture for said third beam than said apertures for said first and second beams and means spacing said cathodes corresponding to said first and second beams farther from said control grid means than the distance of said cathode corresponding to said third beam from said control grid means.

* * * * *